US008109326B2

(12) United States Patent
Larsson et al.

(10) Patent No.: US 8,109,326 B2
(45) Date of Patent: Feb. 7, 2012

(54) HEAT TRANSFER PLATE FOR PLATE HEAT EXCHANGER WITH EVEN LOAD DISTRIBUTION IN PORT REGIONS

(75) Inventors: Hakan Larsson, Kavlinge (SE); Thord Gudmundsson, Malmo (SE); Kerstin Drakarve, Dalby (SE)

(73) Assignee: Alfa Laval Corporate AB (SE)

( * ) Notice: Subject to any disclaimer, the term of this patent is extended or adjusted under 35 U.S.C. 154(b) by 755 days.

(21) Appl. No.: 12/097,597

(22) PCT Filed: Dec. 21, 2006

(86) PCT No.: PCT/SE2006/001469

§ 371 (c)(1),
(2), (4) Date: Sep. 5, 2008

(87) PCT Pub. No.: WO2007/073304

PCT Pub. Date: Jun. 28, 2007

(65) Prior Publication Data

US 2009/0178793 A1 Jul. 16, 2009

(30) Foreign Application Priority Data

Dec. 22, 2005 (SE) ..... 0502877

(51) Int. Cl.
*F28D 9/00* (2006.01)

(52) U.S. Cl. ..... 165/167; 165/166

(58) Field of Classification Search ..... None
See application file for complete search history.

(56) References Cited

U.S. PATENT DOCUMENTS

| | | | | |
|---|---|---|---|---|
| 55,149 A | | 5/1866 | Nason | |
| 4,162,703 A | * | 7/1979 | Bosaeus | 165/167 |
| 4,176,713 A | * | 12/1979 | Fisher | 165/166 |
| 4,246,962 A | | 1/1981 | Norback | |

(Continued)

FOREIGN PATENT DOCUMENTS

DE 10024888 11/2001

(Continued)

OTHER PUBLICATIONS

Int'l Search Report.

(Continued)

*Primary Examiner* — Allen Flanigan
(74) *Attorney, Agent, or Firm* — Fish & Richardson P.C.

(57) ABSTRACT

The invention relates to a heat transfer plate (1) intended to constitute, together with other heat transfer plates, a plate stack (2) with permanently connected plates for a heat exchanger (3), which heat transfer plate (1) has a first long side (4) and an opposite second long side (5), a first short side (6) and an opposite second short side (7), a heat transfer surface (8) exhibiting a pattern (9) of ridges (10) and valleys (11), first and second port regions (12 and 13), the first port region (12) being situated in a first corner portion (14) formed at the meeting between the first long side (4) and the first short side (6), the second port region (13) being situated in a second corner portion (15) formed at the meeting between the second long side (5) and the first short side (6), and the first port region (12) being connected to a number of ridges (10*a-d*) and valleys (11*a-e*), which ridges (10*a-d*) and valleys (11*a-e*) have in principle an extent from the first port region (12) diagonally towards the second long side (5).

16 Claims, 3 Drawing Sheets

U.S. PATENT DOCUMENTS

| | | | | |
|---|---|---|---|---|
| 4,249,597 | A | 2/1981 | Carey | |
| 4,630,674 | A * | 12/1986 | Skoog | 165/147 |
| 5,964,280 | A | 10/1999 | Wehrmann et al. | |
| 5,992,510 | A * | 11/1999 | Kallrot | 165/78 |
| 6,389,696 | B1 * | 5/2002 | Heil et al. | 29/890.039 |
| 2004/0177950 | A1 | 9/2004 | Gluck | |

FOREIGN PATENT DOCUMENTS

| | | | |
|---|---|---|---|
| EP | 0611941 | | 8/1994 |
| EP | 0867679 | | 9/1998 |
| EP | 1452816 | | 9/2004 |
| GB | 1298240 | | 11/1972 |
| JP | 3026231 | | 4/1996 |
| JP | 11-248392 | | 9/1999 |
| JP | 2001248996 | A * | 9/2001 |
| JP | 2002081883 | | 3/2002 |
| RU | 1800255 | A1 | 3/1993 |
| SU | 167507 | | 1/1965 |
| WO | 0146636 | | 6/2001 |
| WO | 0148433 | | 7/2001 |
| WO | 02061357 | | 8/2002 |

OTHER PUBLICATIONS

Russian Communication for Application No. 2008130129, dated Sep. 3, 2010, 12 pages.

* cited by examiner

HEAT TRANSFER PLATE FOR PLATE HEAT EXCHANGER WITH EVEN LOAD DISTRIBUTION IN PORT REGIONS

FIELD OF THE INVENTION

The present invention relates to a heat transfer plate according to the preamble of claim 1. Furthermore, the invention relates to a plate heat exchanger comprising a heat transfer plate of the invention.

BACKGROUND TO THE INVENTION

Japanese patent specification JP 2002-081883 describes a heat exchanger comprising heat transfer plates with similar heat transfer plates. In the ensuing text, the term "heat transfer plate" is synonymous with the term "plate". The plates exhibit a pattern of ridges and valleys extending diagonally across the heat transfer plate. Stacking to form a plate stack entails the plates being placed on one another in such a way that the ridges and valleys of a plate are connected to the ridges and valleys of an adjacent plate via contact points. The mutual orientation of the plates is such that there is mutual divergence of the extent of the ridges and valleys of adjacent plates upon their mutual abutment at said contact points. Mutually adjacent plates are connected via said contact points to form a permanently connected plate stack.

A problem of heat exchangers comprising plates configured according to said patent specification JP2002-081883 is that the contact points round the port regions have a tendency to snap. The term "snap" means the permanent connection between two mutually adjacent plates parting at a contact point. Factors inter alia which influence the degree of risk of a contact point parting are the position of the contact point on the plate and its proximity to other contact points. Round the port regions in the embodiment according to patent specification JP2002-081883, and on many conventional plates, contact points are provided round each port region at different distances from the center of the port region. The result is that the stresses acting at the respective contact points round the port differ because some of the contact points are situated closer to certain contact points than to other contact points. Contact points which are near to one another can thus distribute stresses among them, with the result that the respective contact points will be less affected by said stresses. This means that certain other contact points which are situated round the port regions and are not close to another contact point will therefore have a greater tendency to part than other contact points round the port regions.

A known technique for creating contact points round a port is to press a number of nibs in the region round the port. Said nibs are situated at the same radial distance from the centre of the port. A disadvantage of such an embodiment is that the respective nibs require a large surface to enable them to be pressed in the plate. This means that the plate's heat transfer surface is reduced by the surface devoted to pressing said nibs, with consequent reduction in the heat transfer via said plate.

SUMMARY OF THE INVENTION

A heat exchanger comprises a permanently connected plate stack. The plate stack comprises a number of similar plates stacked on one another. The plates comprise edge portions, port portions and heat transfer surface. The heat transfer surface exhibits a pattern of ridges and valleys. Every second plate in the plate stack is rotated 180° in a plane parallel with the heat transfer surface so that two mutually adjacent plates turned relative to one another do in principle abut against one another via crests of ridges and undersides of valleys. Contact points are thus formed upon abutment between mutually adjacent crests and valleys, which are connected permanently to one another, e.g. by soldering.

An object of the present invention is to create a plate which can be stacked and connected to a similar plate, which plates form contact points round the port regions via their mutually adjacent patterns, said contact points being in principle situated at the same distance from the centre of the port region.

A further object of the invention is to create a plate which comprises between the port regions a distribution surface which is flexurally rigid.

The abovementioned and other objects are achieved according to the invention by the plate described in the introduction having the characteristics indicated by claim 1.

An advantage which is achieved with a plate according to the characterising part of claim 1 is that since the contact points round the respective port region are in principle at the same radial distance from the centre of the respective port region there is even distribution of stresses and loads between said contact points.

A further advantage which is achieved with a plate according to the characterising part of claim 1 is that since the ridges have a continuous extent from the port regions to opposite edge regions the result is a plate which is flexurally and torsionally rigid.

A further advantage which is achieved with a plate according to the characterising part of claim 1 is that each valley which communicates with the respective port region is in the same plane as the inner edge of said port region, which edge defines the port recess, resulting in a uniform flow path for the medium from the port region and along said valley.

Preferred embodiments of the plate further have also the characteristics indicated by subclaims 2-10.

According to an embodiment of the plate according to the invention, the contact points situated on the end portions of the respective ridges, which end portions adjoin said port region, are so positioned that they are adjacent to or are intersected by the extent of a circular arc, the centre of which is situated within the area of the port portion. The port region is defined within the circular arc and a port ridge, which port ridge extends approximately 180° round the portion of the port region which is adjacent to the corner portion of the plate. Since each contact point is in principle situated at the same radial distance from the centre of the port region and since mutually adjacent contact points along the extent of the circular arc are in principle situated at the same distance from one another, no contact point will be subject to greater stress than any other contact point. This is because the loads at a contact point are distributed to adjacent contact points round the port region, thereby preventing high stress concentrations at a single contact point.

According to an embodiment of the plate according to the invention, the heat transfer plate has a central axis parallel with the respective short sides and is symmetrical with respect to the central axis in such a way that substantially every ridge and valley pressed in the heat transfer plate correspond in shape and position to a ridge and valley on the other side of the central axis. The central axis and the respective short sides are in separate planes in the plate. The planes form a right angle with the respective long sides and with a plane parallel with the heat transfer surface.

According to an embodiment of the plate according to the invention, the extent of the central axis differs from the extent of the respective short sides in that the central axis extends across the heat transfer surface from a level at one long side to a different level at the other long side. This helps to ensure that upon abutment between two mutually adjacent plates the distance between the plates at the portions for mutually adjacent central axes will vary. The distance between the plates at one long side therefore differs from the distance between the plates at the other long side. The long side where the distance between mutually adjacent plates is the smaller constitutes the shortest path between the port regions, which is therefore the path most naturally taken by a medium. By varying the distance between mutually adjacent plates along the extent of the central axis, it thus becomes possible to lead the medium to other plate portions, resulting in utilisation of a larger proportion of the heat transfer surface of the plates.

According to an embodiment of the plate according to the invention, each ridge has a first centreline which divides the extent of the ridge into two equal portions, which first centreline in the respective ridge is in principle parallel with the first centrelines of the respective ridges on the respective sides of the central axis. Each ridge has a crest portion. The centreline extends in a plane through the crest portion and the ridge, dividing the extent of the crest portion and the ridge into two equal halves.

According to an embodiment of the plate according to the invention, each valley comprises a second centreline which divides the extent of the valley into two equal portions, whereby the respective second centreline in the respective valley is in principle parallel with the second centrelines of the respective valleys on the respective sides of the central axis. Said second centreline extends in a plane in the valley to an extent which divides the valley into two equal portions. The first and second centrelines in the plate on the respective sides of the central axis are parallel with one another.

Upon abutment between two mutually adjacent plates, the crest portion of the ridges on a first plate is associated with the underside of the valleys of a similar second plate. The second plate is similar to the first plate but rotated 180° about an axis which is perpendicular to a plane which is parallel with the plate's heat transfer surface.

According to an embodiment of the plate according to the invention, two mutually adjacent ridges form between them a valley and the latter's volume per unit width between the ridges varies along its extent. This makes it possible to control and distribute a medium across the whole heat transfer surface. In the case of a plate with a conventional pattern, a medium flowing between two ports endeavours to take the shortest path. By varying the width of the valley through which the medium flows and making the valley wider it is possible to guide the medium to regions which are difficult to cause the medium to act upon. The result is utilisation of portions of the heat transfer surface which in the case of a conventional plate are difficult for the medium to reach, e.g. regions which do not constitute the shortest path between two ports which have medium contact with one another.

According to an embodiment of the plate according to the invention, the ridges comprise a crest portion and, on each side of the centreline, a side portion, which side portions connect the crest portion and the valley to one another, said crest portion being connected to the respective side portions by an arcuate edge portion which has a radius which varies along the extent of the ridge in a manner related to the width of the crest portion so that the smaller the width of the crest portion the smaller the radius. The edge portion between the crest and the side portion being arcuate reduces the risk that solder foil applied between mutually adjacent plates might crack. A specific problem in soldering two plates together with solder foil is that the crests and valleys of the pattern are too angular, resulting in cracking of the solder foil. This may lead not only to regions between the plates not being soldered to one another through lack of solder foil but also the possibility of some of the solder foil being trapped in the production machine.

According to an embodiment of the plate according to the invention, a first ridge and a second ridge form between them a second valley, said first ridge extending between the two port regions and said valley extending from one port region at one long side to the opposite other long side. A continuous ridge extends between the port regions on the respective sides of the central axis and connects said port regions to one another. Said ridge extends in the plate from the first port portion, which is situated at the same level as the crest portions of the ridges, to the second port portion, which is at the same level as the valleys. As mentioned previously, every second plate in the plate stack is rotated 180° so that the first port portion of a first plate connects with the second port portion of a superimposed second plate. In the same way, the second port portion of the first plate connects with the port portion of an underlying second plate. The fact that said ridges on the respective plates extend between the port portions and between said levels and are connected to adjacent plates results in a flexurally rigid and fatigue-resistant structure in this region of the plate stack, since stresses absorbed in the ridges are thus distributed to the port portions, ridges and valleys of adjacent plates.

According to an embodiment of the plate according to the invention, the second ridge is connected to a third ridge by a first connection whereby a third valley is formed between said second and third ridges, which third valley has an open end and a closed end. The second valley extends along both the second ridge and the third ridge. Said second valley is thus formed. The underside of the second ridge is therefore connected by soldering to the crest portions of the second, third and fourth ridges via contact points, which crest portions are adjacent to said first port region. It thus becomes possible for contact points on the respective ridges to be in principle distributed evenly round the respective port region.

According to an embodiment of the plate according to the invention, the plate comprises a first connection as mentioned above which connects two ridges to one another, thereby forming a valley which has an open end and a closed end. The open end communicates with the first port region. The two ridges are adjacent to a valley which itself is also adjacent to the second port region. The above construction with two connected ridges and said valley, which valley is adjacent to the second port region, makes it possible to create contact points on the end portions of the ridges which are adjacent to the first port region.

According to an embodiment of the plate according to the invention, the plate comprises a second and a third connection. The second and third connections connect two mutually adjacent ridges to one another. The distance between the first connection and the central axis is greater than the distance of the second and third connections from the same central axis. Moreover, the second connection is situated closer to the second long side than the first and third connections. In a corresponding manner, the third connection is situated closer to the first long side than the first and second connections. The distance from the first short side to the respective connection is shorter than the distance from the central axis to the respective connection. The major portion of the first connection is situated closer to one of the two long sides. The first connection is situated closer to the second connection than the third connection. The second and third connections are situated on the heat transfer surface, since they constitute so-called support surfaces. The support surfaces are used for releasing the plate from the tool in which the plate is pressed. One object is therefore that said support surfaces be situated in such a way on the heat transfer surface that they have the least possible adverse effect on the total heat transfer through the plate.

The invention further relates to a plate heat exchanger made up of heat transfer plates according to any one of claims 1-10

By the plate heat exchanger of the present invention a heat exchanger having excellent pressure-resistant and fatigue-resistance is obtained.

BRIEF DESCRIPTION OF THE DRAWINGS

Preferred embodiments of the device according to the invention are described below in more detail with reference to the attached schematic drawings, which only depict the parts which are necessary for understanding the invention.

DETAILED DESCRIPTION OF VARIOUS EMBODIMENTS OF THE INVENTION

Figure 1:
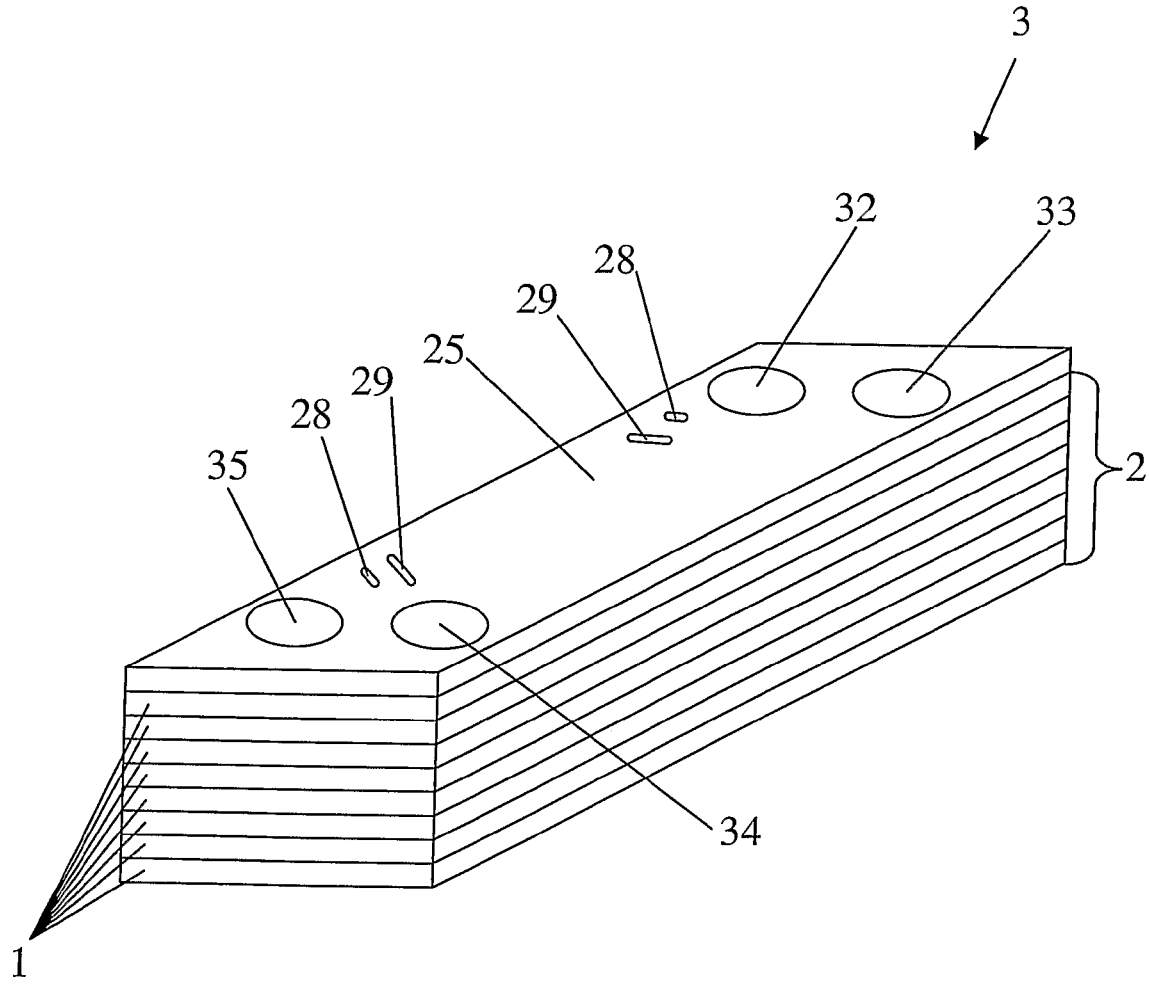
FIG. 1 depicts a heat exchanger with a means and a plate stack.

FIG. 1 depicts a heat exchanger (3) comprising a plate stack (2) and at least one means (25). The heat exchanger (3) is provided with a number of inlet and outlet ports with port recesses (32-35) for a medium. The plate stack (2) comprises a number of plates (1) permanently connected to one another by a known connection method. Known connection methods are, inter alia, soldering, welding, adhesive and bonding.

Figure 2:
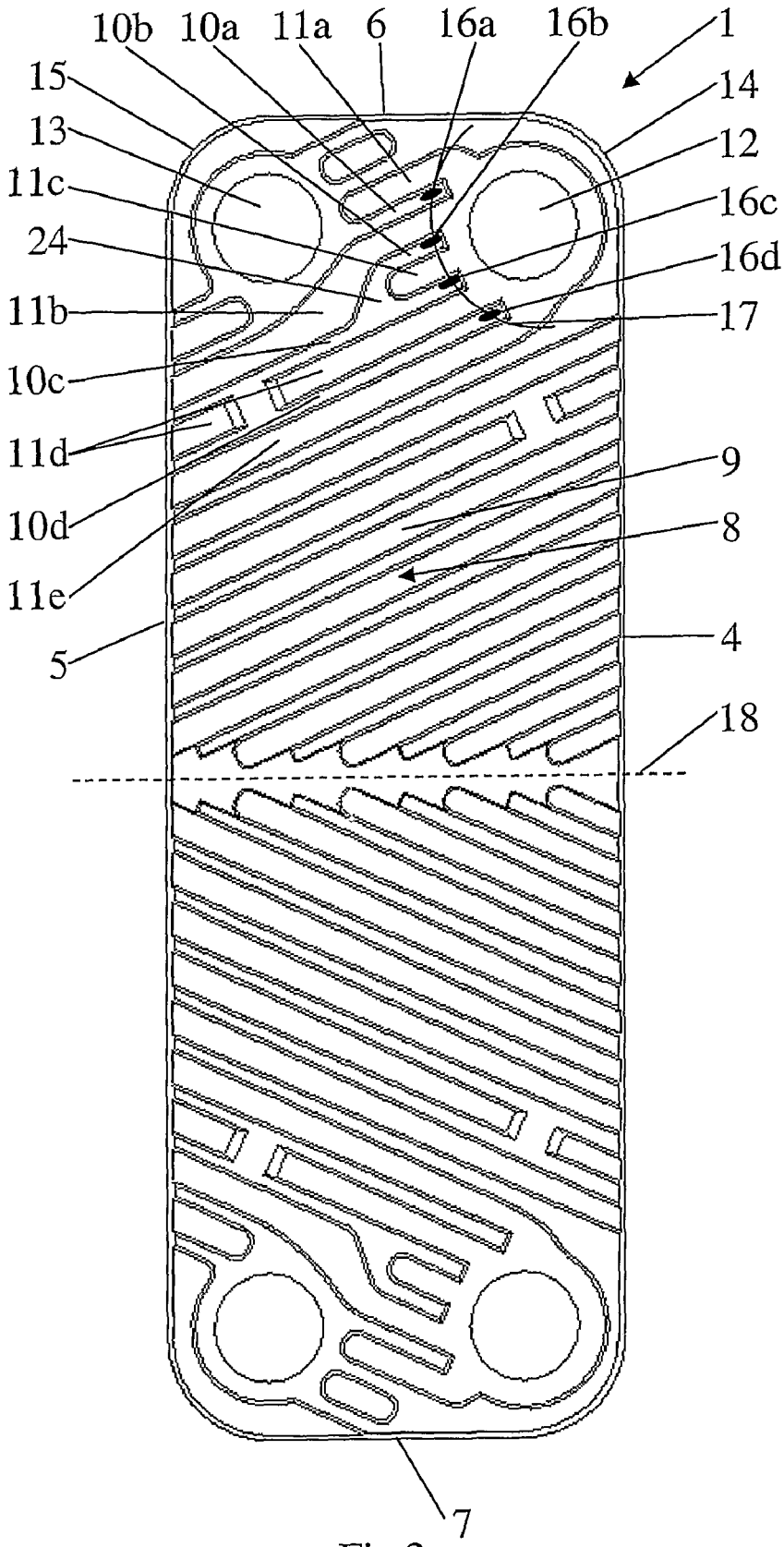
FIG. 2 depicts a heat transfer plate.

FIG. 2 depicts a plate (1) according to the invention. The plate (1) comprises first and second long sides (4 and 5), first and second short sides (6 and 7), a heat transfer surface (8) with a pattern (9) comprising ridges (10*a-d*) and valleys (11*a-e*). A first corner portion (14) is formed at the connection between the first short side (6) and the first long side (4). A second corner portion (15) is situated at the connection between the first short side (6) and the second long side (5). A first port region (12) is situated in the first corner portion (14). A second port region (13) is formed in the second corner portion (15). A central axis (18) extends transversely across the plate (1) between and perpendicular to the two long sides (4 and 5). The central axis (18) divides the plate (1) into two equal halves. The halves are mirror images to one another in shape, pattern and contour. This means that the plate (1) comprises in all four corner portions, four port regions, etc. As the plate (1) is symmetrical about said central axis (18), this description refers only to said technical features pertaining to one half of the plate.

The plate (1) is stacked in a plate stack (2, see FIG. 1) with similar plates (1). Every second plate (1) in said plate stack (2) is rotated 180° in a plane parallel with the heat transfer surface (8). Each plate (1) comprises an upper side and a lower side. All the plates (1) in the plate stack (2) are placed on one another with their respective undersides facing the same direction. Such stacking results in the top side of the pattern (9) of a first plate (1) abutting against the pattern (9) on the underside of a rotated similar second plate (1).

The first port region (12) communicates with a number of ridges (10*a-d*) and valleys (11*a-e*). The ridges (10*a-d*) and valleys (11 *a-e*) on the plate (1) on the respective sides of the central axis (18) are all in principle parallel with one another.

A contact point (16*a-d*) is formed on the end portion of each of the respective ridges (10*a-d*) which are adjacent to the first port region (12). Said contact points (16*a-d*) are in principle situated at the same radial distance from the centre of the first port region (12). The contact points (16*a-d*) follow the extent of a circular arc (17) round the port region (12). The centre of the circular arc (17) is within the area of the first port region (12).

Stacking two mutually adjacent plates (1) in said plate stack (2, see FIG. 1) will result in a first contact point (16*a*) on a first plate (1) abutting against the underside of a first valley (11*a*) on a rotated similar second plate (1) placed on said first plate (1). Second, third and fourth contact points (16*b-d*) will correspondingly abut against the underside of a second valley (11*b*) of the same plates (1) as in the case of the first contact point (16*a*) and the first valley (11*a*).

A second ridge (10*b*) is connected to a third ridge (10*c*) by a first connection (24). The second valley (11 *b*) is adjacent to the second ridge (10*b*), the third ridge (10*c*), the first ridge (10*a*) and the second port region (13). The second ridge (10*b*) extends between said first connection (24) and the first port region (12). The result is the formation of said second valley (11*b*) which not only runs round part of the second port region (13) but is also adjacent to the heat transfer surface (8) of the plate (1). The second valley (11*b*) follows initially the second ridge (10*b*) from the first port region (12) to the first connection (24). At that connection (24) the valley (11 *b*) is compelled to change direction in order thereafter to follow the third ridge (10*c*) to the second long side (5). The fact that the second valley (11 *b*) runs round part of the second port region (13) results in the formation on its underside of an elongate area round part of said second port region (13). Said region (13) connects to the second, third and fourth contact points (16*b-d*). As a result of said first connection (24) the ridges (10*a-d*) can be parallel with one another and said contact points can be situated on the ridges (10*b-d*) at in principle the same radial distance from the centre of the first port region (12). This makes it possible for there to be uneven stressing at respective contact points (16*a-d*) round the first port region (12).

Figure 3:
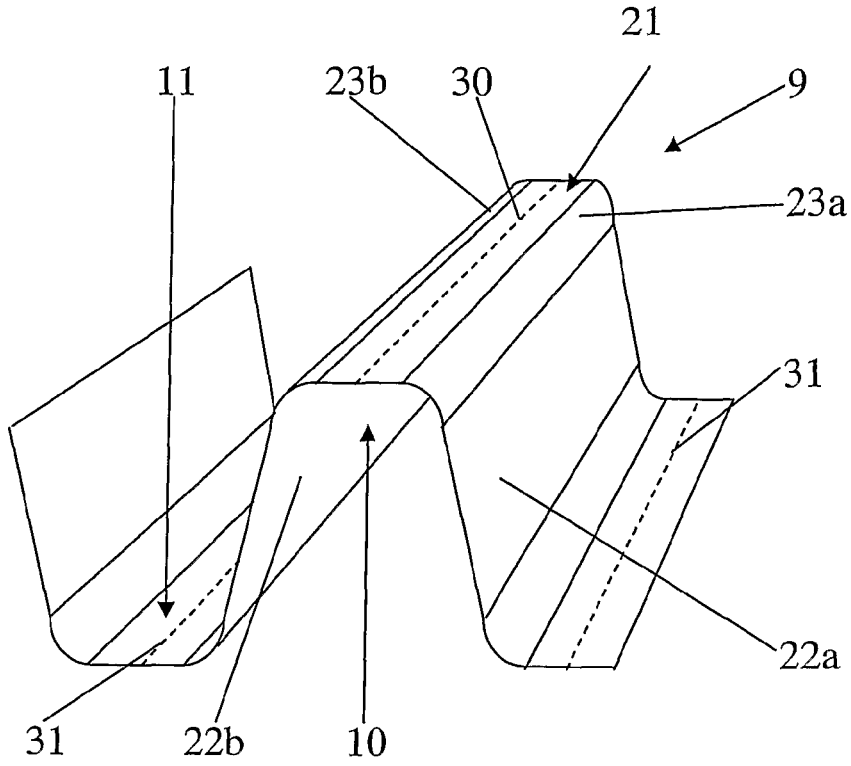
FIG. 3 depicts part of a pattern on a heat transfer plate.

FIG. 3 depicts part of a pattern (9) in a plate (1, see FIG. 2) according to the invention. For the sake of comprehension, FIG. 3 depicts only one ridge (10) and one valley (11), whereas the plate (1) according to the invention comprises a number of ridges and valleys. In FIG. 3 the ridge (10) comprises a crest portion (21) and two side portions (22*a, b*). The respective side portions (22*a, b*) are connected to the crest portion (21). The valley (11) is connected to the crest portion (21) by the side portions (22*a, b*). The crest portion (21) has the same extent as the ridge (10) and the valley (11). An arcuate edge portion (23*a, b*) which has the same extent as the ridge (10) connects, on its respective side of the crest portion (21), the respective side portion (22*a, b*) to said crest portion (21). A first centreline (30), which has the same extent as the ridge (10), is situated in and along the crest portion (21). A second centreline (31), which has the same extent as the valley (11), is situated in and along the valley (11).

Each ridge (10) varies in width along its extent so that the smaller the width of the ridge (10) the smaller the width of the crest portion (21). The radius of the arcuate edge portion (23*a, b*) varies correspondingly so that the smaller the width of the crest portion (21) the smaller the radius. The width of the respective valley (11) varies along its extent in a similar manner to the ridge (10) and its crest portion (21).

The centrelines (30, 31) of each ridge (10) and valley (11) are parallel with one another on their respective sides of the central axis (18, see FIG. 2).

The fact that the ridges (10) and the valleys (11) vary in width and hence in volume per unit width makes it possible to lead a medium to parts of the heat-transmitting surface of the plate (1) which in conventional plates are difficult to cause the medium to act upon. The fact that the volume per unit width is increased in the regions which are difficult to cause the medium to act upon makes it possible to utilise a larger surface on a plate (1) for heat transfer.

Figure 4:
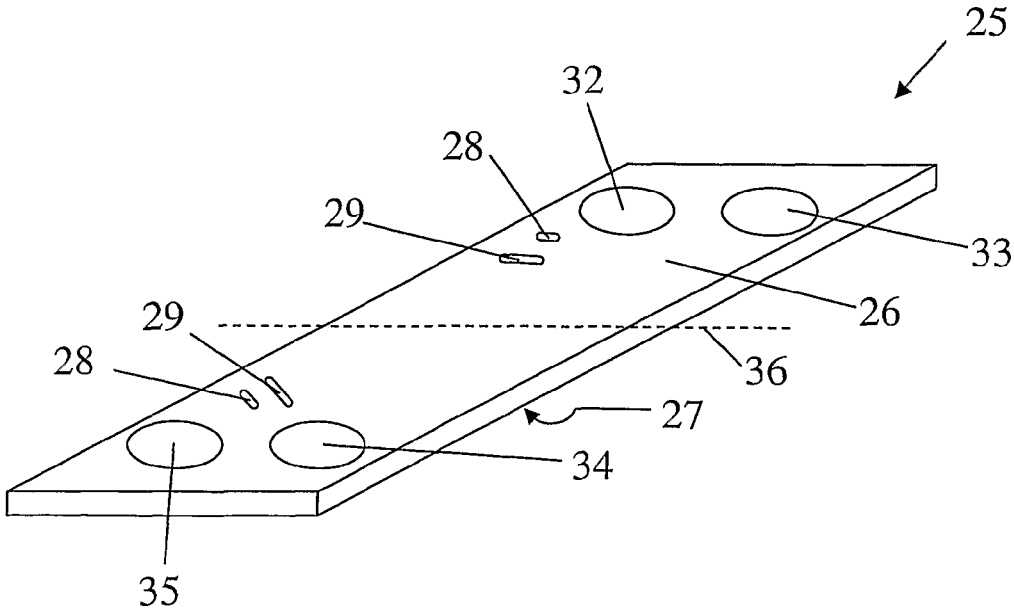
FIG. 4 depicts a means for use on a heat exchanger.

FIG. 4 depicts a means (25). The means (25) has correspondingly the same outer periphery as a plate (1, see FIG. 1) stacked on similar plates (1) in a plate stack (2). The means (25) comprises a first surface (26), a second surface (27, not shown in the drawings) and port recesses (32-35). A first protrusion (28) and a second protrusion (29) are pressed in the first surface (26) on the respective sides of a second central axis (36). The position of this second central axis (36) corresponds to the central axis (18) of a plate (1, see FIG. 2) according to the invention. The respective protrusions (28, 29) stick out from the second surface (27, not shown in the drawings).

The means (25) is placed on the first and/or the last plate (1) in the plate stack (2, see FIG. 1). The protrusions (28, 29) in the second surface (27, not shown in the drawings) are shaped to fit into the pattern (9, see FIG. 2) on an adjacent plate (1). Upon abutment between the means (25) and the adjacent plate (1) the first protrusion (28) is inserted in the second valley (11*b*) in the plate (1). The second protrusion (29) is inserted in the fifth valley (11*e*). Both the second valley (11*b*) and the fifth valley (11*e*) communicate with the first port region (12).

In a plate stack (2) according to the invention it is desirable to be able to reduce the amount of medium which accumulates during operation between the means (25) and the adjacent plate (1). The insertion of said protrusions (28, 29) in a number of the valleys (11*b*, 11*e*) which communicate with the first port region (12) prevents flow of medium in these valleys (11*b*, 11*e*) from said port region (12) to the second long side (5). The result is optimisation of the total heat transfer in the heat exchanger (3) in that medium which does not contribute to heat transfer is reduced.

The invention is not limited to the embodiment referred to but may be varied and modified within the scopes of the claims set out below, as has been partly described above.

The invention claimed is:

1. A heat transfer plate intended to constitute, together with other heat transfer plates, a plate stack with permanently connected plates for a heat exchanger, which heat transfer plate comprises a first long side and an opposite second long side, a first short side and an opposite second short side, a heat transfer surface exhibiting a pattern of ridges and valleys, first and second port regions, the first port region being situated in a first corner portion formed at the meeting between the first long side and the first short side, the second port region being situated in a second corner portion formed at the meeting between the second long side and the first short side, and the first port region being connected to a number of ridges and valleys, which ridges and valleys have in principle an extent from the first port region diagonally towards the second long side, wherein a number of contact points are situated on the ridges in direct proximity to the first port region, which contact points are so positioned that at least one contact point adjoins two contact points, the contact points being in principle at the same radial distance from the center of the first port region wherein a first ridge and a second ridge form between them a second valley, the first ridge extending between the two port regions and the valley extending from one port region at one long side to the opposite second long side; and wherein the second ridge is connected to a third ridge by a first connection whereby a third valley is formed between the second and third ridges, which third valley has an open end and a closed end.

2. A heat transfer plate according to claim 1, wherein the contact points situated on the end portions of the respective ridges, which end portions adjoin the first port region, are so positioned that respective contact points are adjacent to or intersected by the extent of a circular arc.

3. A heat transfer plate according to claim 1, wherein the heat transfer plate has a central axis parallel with the respective short sides and is symmetrical with respect to the central axis in such a way that substantially every ridge and valley pressed in the heat transfer plate correspond in form and position to a ridge and valley on the other side of the central axis.

4. A heat transfer plate according to claim 3, wherein each ridge has a first center line dividing the extent of the ridges into two equal portions, which first center line in the respective ridges is in principle parallel with the first center lines of the respective ridges on the respective sides of the central axis.

5. A heat transfer plate according to claim 4, wherein each valley has a second center line dividing the extent of the valleys into two equal portions, whereby the respective second center lines in the respective valleys are in principle parallel with the second center lines of the respective valleys on the respective sides of the central axis.

6. A heat transfer plate according to claim 1, wherein two adjoining ridges form between them a valley whose width between the ridges varies along the extent of the valley.

7. A heat transfer plate according to claim 4, wherein the ridges comprise a crest portion and, on each side of the center line, a side portion, which side portions connect the crest portion and the valley to one another, the crest portion being connected to each side portion by an arcuate edge portion whose radius varies along the extent of the ridges in a manner related to the width of the crest portion so that the smaller the width of the crest portion the smaller the radius.

8. A heat transfer plate according to claim 1, wherein the second valley extends along both the second ridge and the third ridge.

9. A plate heat exchanger comprising a plate stack, the plate stack further comprising at least one heat transfer plate according to claim 1.

10. A plate heat exchanger comprising a plate stack, the plate stack further comprising at least one heat transfer plate according to claim 2.

11. A plate heat exchanger comprising a plate stack, the plate stack further comprising at least one heat transfer plate according to claim 3.

12. A plate heat exchanger comprising a plate stack, the plate stack further comprising at least one heat transfer plate according to claim 4.

13. A plate heat exchanger comprising a plate stack, the plate stack further comprising at least one heat transfer plate according to claim 5.

14. A plate heat exchanger comprising a plate stack, the plate stack further comprising at least one heat transfer plate according to claim 6.

15. A plate heat exchanger comprising a plate stack, the plate stack further comprising at least one heat transfer plate according to claim 7.

16. A plate heat exchanger comprising a plate stack, the plate stack further comprising at least one heat transfer plate according to claim 8.

* * * * *